US005103933A

United States Patent [19]

Huff

[11] Patent Number: 5,103,933

[45] Date of Patent: Apr. 14, 1992

[54] ONE PIECE LEG

[76] Inventor: Larry T. Huff, 40 Crestwood Ct., Danville, Ind. 46122

[21] Appl. No.: 694,069

[22] Filed: May 1, 1991

[51] Int. Cl.[5] ..... B27B 21/00; B25H 1/06

[52] U.S. Cl. ..... 182/18; 182/46; 182/184; 182/224

[58] Field of Search ..... 182/181-185, 182/224

[56] References Cited

U.S. PATENT DOCUMENTS 1,710,644 4/1929 Hilton .
2,449,501 9/1948 Oertle .
2,846,274 8/1958 Nakano .
3,089,682 5/1963 Parker ..... 182/181
3,456,100 7/1968 Green .
3,799,507 3/1974 Rizzo .
3,950,873 4/1976 Stehle et al. .
4,124,093 11/1978 Breisch ..... 182/46
4,231,676 11/1980 Smith et al. .
4,730,698 3/1988 Harris ..... 182/181
4,859,983 8/1989 Kulp et al. .
4,943,035 7/1990 Thomson et al. .

*Primary Examiner*—Reinaldo P. Machado
*Attorney, Agent, or Firm*—Woodard, Emhardt, Naughton Moriarty & McNett

[57] ABSTRACT

A one piece plastic leg construction. A main body having an inverted v-shaped configuration includes a pair of downwardly extending legs each having a c-shaped cross section. The legs are mutually opposed and open toward each other and include a plurality of horizontally extending inner walls. Indicating means on the outer surface of each leg provides a guide for severing the leg immediately beneath a particular inner wall depending upon the height desired of the final leg construction. A pair of upwardly extending walls are integrally mounted to the legs forming a channel to receive the object to be supported by the construction.

12 Claims, 3 Drawing Sheets

ONE PIECE LEG

BACKGROUND OF THE INVENTION

1. Field of the Invention

This invention is in the field of legs utilized for such items as barricades, saw horses and other construction devices.

2. Description of the Prior Art

Construction devices including barricades and saw horses typically include inverted v-shaped legs mounted to the opposite ends of a horizontally extending member. Typically, the legs are produced from metal or wood. Several disadvantages exist with such devices. First, both types of construction include joints which will loosen through repeated use providing for an unstable structure. In the case of metal structures, the construction is susceptible to weather deterioration developing rust and an unattractive appearance. A major disadvantage of metal and wooden leg constructions is the relatively heavy weight associated with the construction. As a result, it is relatively difficult to transport such devices. Likewise, the metal or wooden legs are originally designed to position and support a member at a fixed elevation above ground. As a result, the construction cannot be easily changed in the event a different elevation is desirable.

In view of the above limitations, I have designed a one piece plastic construction having the traditional inverted v-shaped configuration simulating the traditional apparance. The plastic legs may be utilized for a variety of applications including forming a barricade or a saw horse. The plastic construction is durable without the traditional joints thereby alleviating wobble and providing for a sturdy structure. The plastic construction is completely weather resistant and may be molded to have a florescent appearance increasing the visibility of the device. The leg construction disclosed herein is very light weight providing for ease of transportation and is designed to easily and quickly attach to the object being supported. Most importantly, the legs are designed to be severed at different locations to allow the user to support the object at the particular desired elevation.

SUMMARY OF THE INVENTION

One embodiment of the present invention is a support for releasably holding an object comprising a main body having a unitary one piece construction produced from plastic material located symmetrically about a vertical axis. The main body includes a pair of downwardly extending legs having top end portions integrally joined together and further having bottom end portions spaced apart to rest atop a supporting surface. The legs converge from the bottom end portions to the top end portions. The main body further includes a pair of spaced apart walls located atop the top end portions of the legs forming a channel to mountingly receive the object being supported. A fastening device is provided at the spaced apart walls to releasably hold the object thereto.

It is an object of the present invention to provide a unitary plastic leg construction for supporting an object.

A further object of the present invention is to provide a light weight sturdy leg construction for use in construction applications.

In addition, it is an object of the present invention to provide a leg construction having means to allow the length of the leg to be changed depending upon the desired elevation of the object to be supported by the leg.

Related objects and advantages of the present invention will be apparent from the following description.

DESCRIPTION OF THE PREFERRED EMBODIMENT

Figure 1:
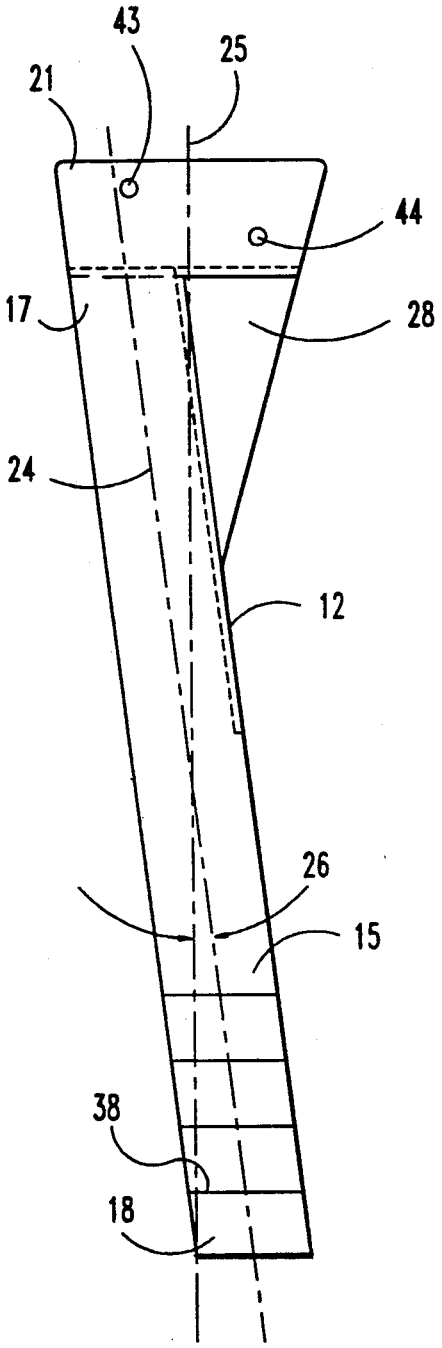
FIG. 1 a side view of the leg construction incorporating my present invention.

For the purpose of promoting an understanding of the principle of the invention, reference will now be made to the embodiment illustrated in the drawings and specific language will be used to described the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 7:
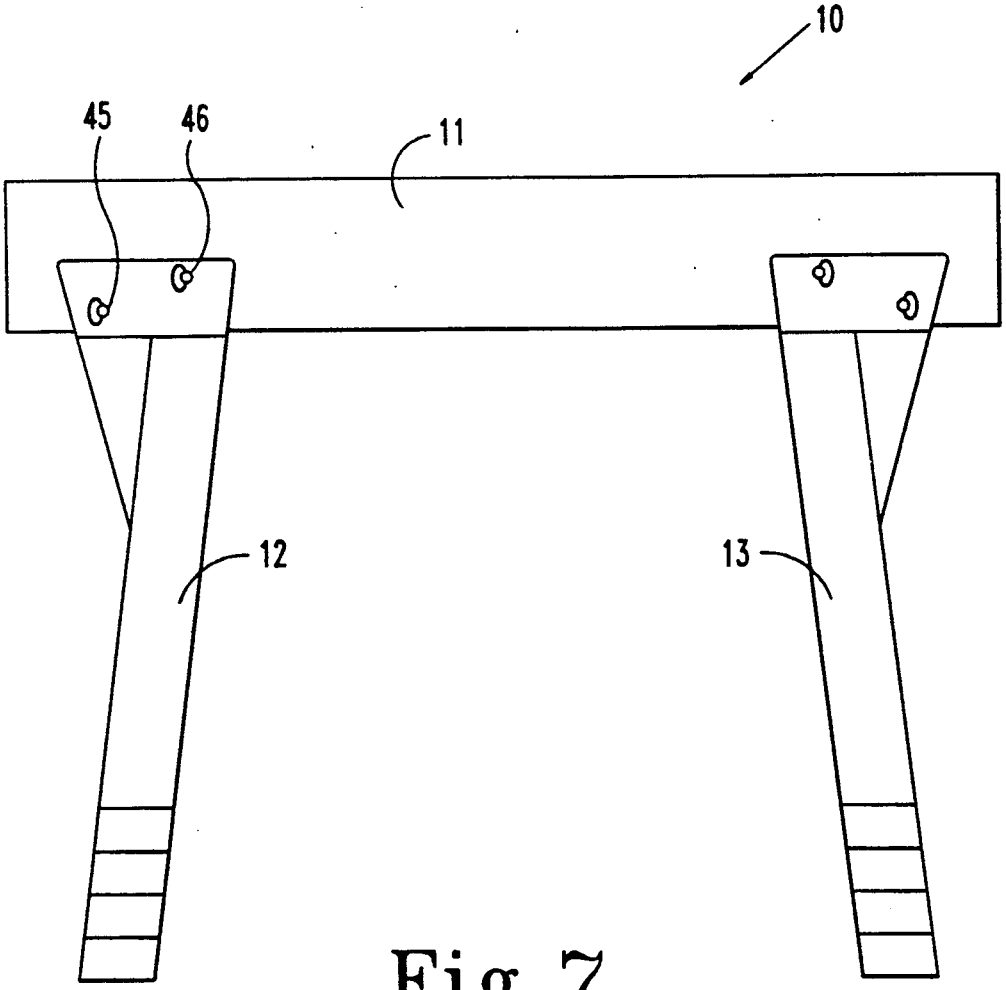
FIG. 7 a side view of a saw horse incorporating two of the leg constructions of FIG. 1.

Referring now more particularly to FIG. 7, there is shown one particular use of the leg construction incorporating my present invention. A saw horse 10 is depicted having a horizontally extending wooden beam 11 supported upon identical leg constructions 12 and 13. The legs include many uses such it forming a barricade or work table as well as other types of construction applications. Leg construction 12 will now be described it being understood that an identical description applies to leg construction 13. Leg construction 12 has a pair of downwardly extending legs 14 and 15 (FIG. 1–3) with respectively top end portions 16 and 17 integrally joined together and with the bottom end portions 18 and 19 spaced apart atop the supporting surface or ground. The legs converge from the bottom end portions to the top end portions and have a pair of parallel upwardly extending walls 20 and 21 integrally mounted and perpendicularly arranged to a horizontal wall 23 integrally formed atop top portions 16 and 17 of the legs. Walls 20–23 form a channel to mountingly receive the object to be supported such as the wooden beam 11 of FIG. 7. Each leg has a longitudinal axis extending centrally therethrough and arranged at an angle relative to the vertical axis. For example, leg 15 includes a longitudinal central axis 24 arranged with respect to vertical axis 25 by angle 26. Angle 26 is sufficiently great so that the top end portion 17 (FIG. 1) is located on one side of the vertical axis whereas the bottom end 18 of the leg is located on the opposite side of the vertical axis. In other words, the top end 17 of the leg is off-set relative to the bottom end 18. Similarly, the top end of leg 14 is off-set relative to the bottom end of leg 14.

Figure 2:
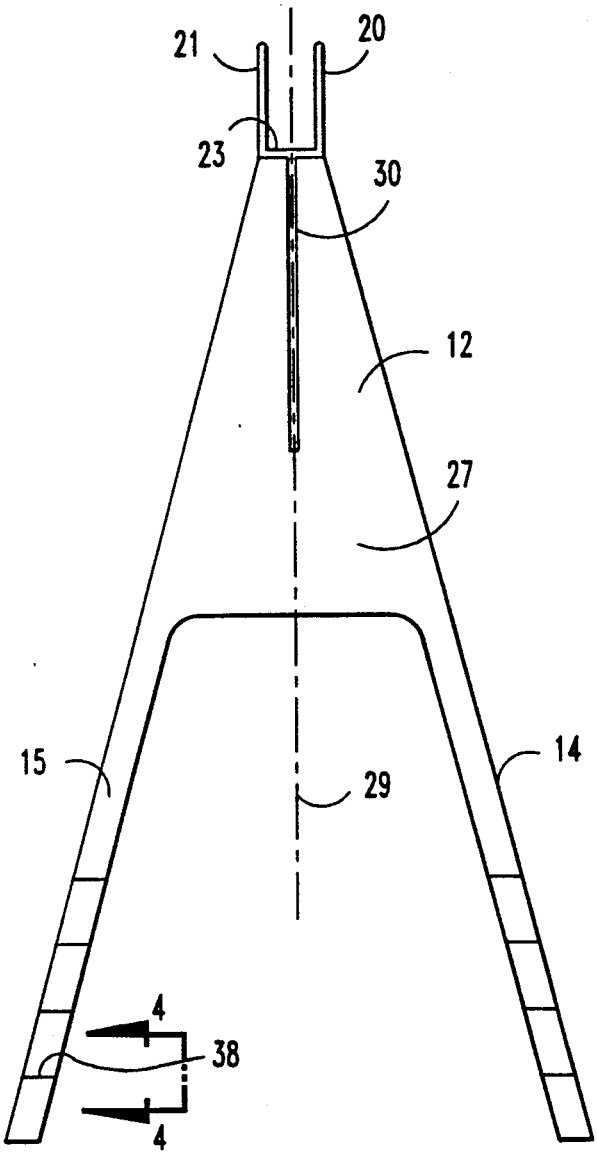
FIG. 2 a right end view of the construction of FIG. 1.
Figure 3:
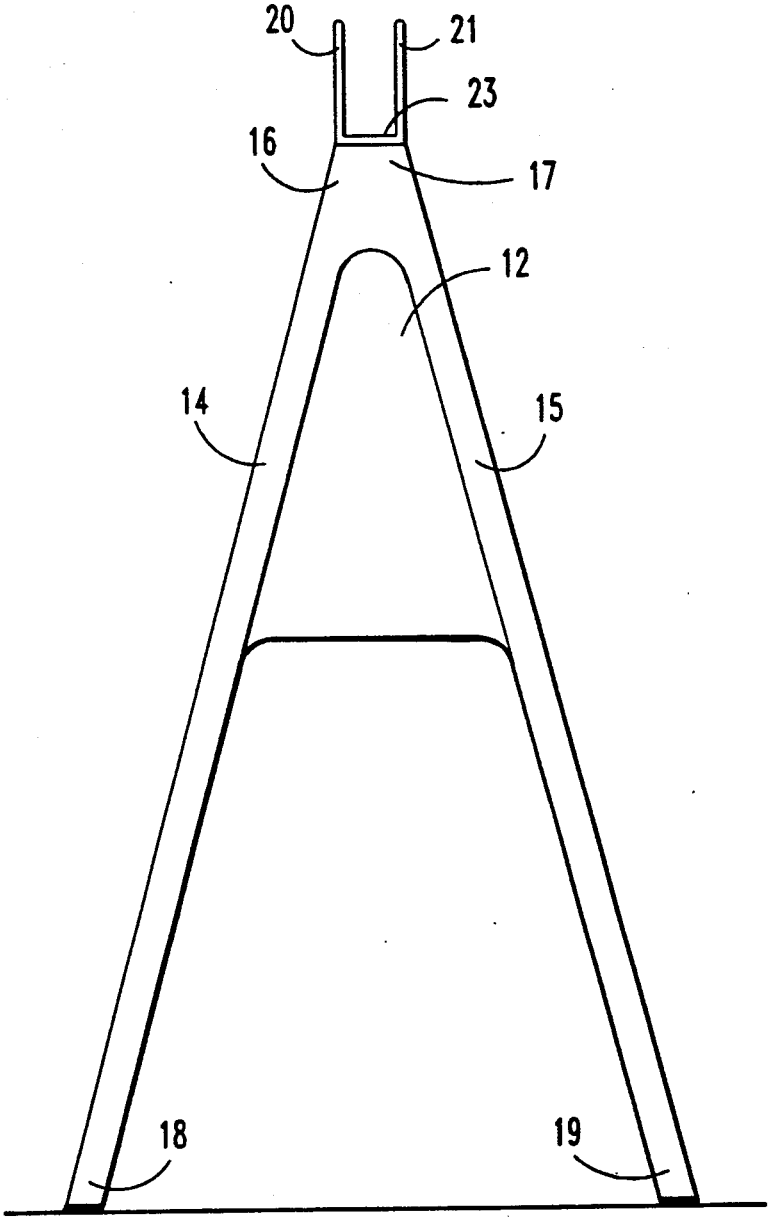
FIG. 3 a left end view of the construction of FIG. 1.

An intermediate wall 27 (FIG. 2) extends between and connects leg 14 to leg 15. The top end of intermediate wall 27 is integrally connected to channel wall 23 whereas the bottom end of wall 27 terminates intermediate the top ends and bottom ends of the legs. Intermediate wall 27 is contained in a plane parallel to the longitudinal central axis 24 of each leg. Thus, intermediate wall 27 intersects the vertical axis 25 at the same angle 26 between the vertical axis and longitudinal axis 24. Brace 30 (FIG. 2) is integrally attached to the outer surface of intermediate wall 27 and extends upwardly to and beneath wall 23 providing additional support. Brace 30 is perpendicularly arranged relative to intermediate wall 27 and bottom wall 23 and has a triangular shape 28 (FIG. 1). The legs, intermediate wall 27, brace 30 as well as walls 20–23 are integrally formed by molding the entire construction from plastic. Superior strength may be achieved by utilizing fiberglass reinforced thermoplastics in the molding process. Thus, leg constructions 12 and 13 each have a unitary one piece construction. As shown in FIG. 2, the leg construction is symmetrical about a vertical plane containing vertical axis 29 with the plane extending upwardly through brace 30 and located equidistant between walls 20 and 21 as well as legs 14 and 15.

Figure 4:
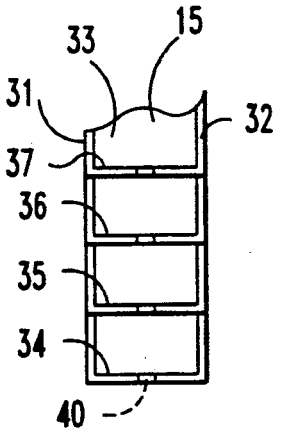
FIG. 4 a fragmentary view of one of the legs looking in the direction of arrows 4—4 of FIG. 2.
Figure 5:
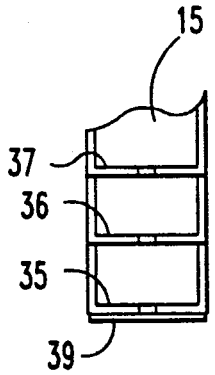
FIG. 5 the same view as FIG. 4 only showing a portion of the leg severed and a removable pad mounted thereto.

Legs 14 and 15 each have a c-shaped cross section opening inwardly toward each other. For example, leg 15 includes a pair of parallel leg walls 31 (FIG. 4) and 32 integrally joined perpendicularly to an intermediate wall 33 extending therebetween. A plurality of horizontal extending and parallel inner walls 34–37 are integrally joined to and extend between the first leg walls 31 and 32 and likewise are integrally joined to the third leg wall 33. Inner walls 34–37 are designed to provide the lower most supporting surface for the leg depending upon the length of the leg desired for elevating the object supported by the leg. In FIG. 4, wall 34 provides the bottom support surface for the leg. In order to shorten the leg, walls 31–33 may be severed immediately beneath the inner wall thereby discarding the lower most portion. For example, by severing walls 31–33 immediately beneath and adjacent inner wall 35, the leg is thereby shortened as shown in FIG. 5 with inner wall 35 thereby providing the supporting lower most surface for the leg. That portion of the leg beneath wall 35 may therefore be discarded. Since legs 12 and 13 are identical, the horizontally extending inner walls 34–37 of leg 15 are aligned with the similar inner walls provided for leg 14. Thus, in the event a portion of leg 15 is removed then an identical portion is removed from leg 14 in the identical manner thereby insuring the construction does not become tilted.

Indicating means are provided on the outwardly facing surface of each leg to allow the user to accurately sever the leg in the event the leg is to be shortened. The indicating means may take the form of a line 38 provided on the outwardly facing surfaces of walls 31–33 immediately beneath the inner wall to be severed. For example, in FIG. 1, line 38 is shown immediately adjacent and beneath inner wall 35 thereby providing a guide to allow the user to sever or cut the walls to shorten the leg. The indicating means or lines on legs 14 and 15 are aligned with each other to insure each leg is of the same length. By removing a portion of each leg, the desired elevation of the channel formed by walls 21–23 is achieved.

Figure 6:
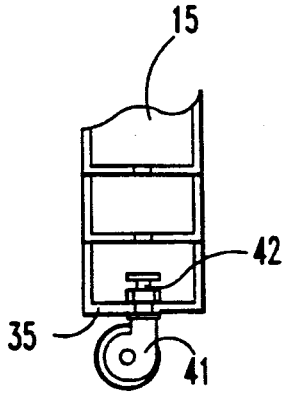
FIG. 6 the same view as FIG. 5 only showing a caster wheel mounted to the bottom of the leg.

Various means may be provided to provide additional support for the lower most inner wall. For example, in FIG. 5, a non-skid pad 39 is affixed by adhesive or other suitable means to the downwardly facing surface of inner wall 35. Alternatively, a conventional caster wheel 41 (FIG. 6) may be mounted to the lower most wall. Each inner wall 34–37 includes an aperture 40 extending therethrough. In FIG. 6, a conventional caster wheel 41 is shown with an upwardly extending mounting rod 42 extending through aperture 40 and mounting the caster wheel to the lower most inner wall 35.

A variety of fastening means may be utilized to secure the object or beam 11 between and to the upwardly extending walls 20 and 21. To this extent, walls 20 and 21 include a first pair of aligned holes 43 located above the top end 16 and 17 of the legs and a second pair of aligned holes 44 positioned above wedge shaped wall 30. The object or beam 11 to be secured to walls 20 and 21 likewise includes a first and second pair of holes aligned with holes 43 and 44 to receive a fastening device. A cotterless hitch pin 45 and 46 (FIG. 7) may be extended respectively through holes 44 and 43 with the pins extending through both walls 20 and 21 as well as beam 11 thereby releasably securing the beam within the channel formed by walls 20–23. Similarly, pins or other fastening devices may be utilized to secure the upwardly extending walls of leg support 13 to beam 11. Hole 43 may have a different diameter than hole 44 and is located upwardly toward the top edge of walls 20 and 21 whereas hole 44 is located nearer wall 23 in order to allow quick matching of the holes in beam 11 which have the same size and location as holes 43 and 44.

The construction disclosed here provides a minimum of assembly plant time and likewise is easy and quick to assemble on site. By molding the construction from plastic, the color of the final construction may be easily controlled. Thus, the leg construction may have a florescent color providing for great visibility.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A support for releasably holding an object comprising:

a main body having a unitary one piece construction produced from plastic material and located symmetrically about a vertical plane, said main body including a pair of downwardly extending legs having top end portions integrally joined together and further having bottom end portions spaced apart to rest atop a supporting surface, said legs converge from said bottom end portions to said top end portions, said main body further includes a pair of spaced apart walls located atop said top end portions of said legs forming a channel to mountingly receive said object; and, fastening means provided at said spaced apart walls to releasably hold said object thereto; and wherein:

said legs each have a longitudinal axis extending centrally therethrough and have a vertical axis intersecting said longitudinal axis locating said top ends on one side of said vertical axis and said bottom ends located on an opposite side of said vertical axis.

2. A support for releasably holding an object comprising:

a main body having a unitary one piece construction produced from plastic material and located symmetrically about a vertical plane, said main body including a pair of downwardly extending legs having top end portions integrally joined together and further having bottom end portions spaced apart to rest atop a supporting surface, said legs converge from said bottom end portions to said top end portions, said main body further includes a pair of spaced apart walls located atop said top end portions of said legs forming a channel to mountingly receive said object; and, fastening means provided at said spaced apart walls to releasably hold said object thereto; and wherein:

said bottom end portions include indicating means located on each leg with said indicating means on one leg aligned with said indicating means on the other leg, said indicating means marking alternative locations of each leg for severing and removing part of said bottom end portions to adjust the height of said channel relative to said supporting surface.

3. The support of claim 3 wherein:

said walls are parallel and extend upwardly providing horizontal stability to said object with each including a pair of spaced apart apertures.

4. The support of claim 3 wherein:

each of said legs include a c-shaped cross section opening inwardly toward each other, said c-shaped cross section of each leg has a first leg wall and a second leg wall in parallel arrangement joined together by a third leg wall extending perpendicularly therebetween, each leg includes a plurality of horizontally extending and parallel inner walls integrally joined to and extending between said first leg wall, second leg wall and third leg wall, said inner walls of one leg aligned with inner walls of the other leg; and, said indicating means includes marks on each leg at said inner walls allowing said first leg wall, second leg wall, and third leg wall to be severed thereat providing the lowermost of said inner walls to support said legs upon said supporting surface.

5. The support of claim 4 and further comprising:

a plurality of wheels rotatably mounted to said lower end portions of said legs to support said main body above said supporting surface; and wherein:

said inner walls include holes formed thereon to mountingly receive said wheels.

6. The support of claim 4 and further comprising:

a non-skid pad removably mountable to the lowermost of said inner walls.

7. The support of claim 4 wherein:

said legs each have a longitudinal axis extending centrally therethrough and have a vertical axis intersecting said longitudinal axis locating said top ends on one side of said vertical axis and said bottom ends located on an opposite side of said vertical axis.

8. A leg for supporting an object comprising:

a one piece plastic main body including a first downwardly extending member and a second downwardly extending member having top ends integrally connected together and bottom ends spaced apart to support said main body atop a supporting surface, said first member and second member include respectively a first longitudinal axis and a second longitudinal axis extending centrally therethrough with said first axis and said second axis diverging apart from said top ends to said bottom ends and include a mounting wall integrally connected to said top ends; and, fastening means extendable through said mounting wall to releasably hold said object to said plastic main body; and wherein:

said first member and said second member each include indicating means thereon including a plurality of markings with said markings on said first member aligned with said markings on said second member, said first member and second member having a thickness to be severed at a particular marking on said first member and at a marking on said second member aligned with said particular marking to control the distance of said mounting wall from said supporting surface.

9. The leg of claim 8 and further comprising:

an intermediate wall extending between and connected to said first member and said second member and extending in a plane parallel to said first axis and said second axis; and, a brace integrally and perpendicularly connected to said mounting wall and said intermediate wall.

10. The leg of claim 9 wherein:

said first member and said second member each include a c-shaped cross section opening inwardly toward each other, said c-shaped cross section has a first leg wall and a second leg wall in parallel arrangement joined together by a third leg wall extending perpendicularly therebetween, each member includes a plurality of horizontally extending and parallel inner walls integrally joined to and extending between said first leg wall, said second leg wall and said third leg wall, said inner walls of said first member aligned with inner walls of said second member; and, said markings includes marks on each member at said inner walls allowing said first leg wall, said second leg wall, and said third leg wall to be severed thereat providing the lowermost of said inner walls to support same upon said supporting surface.

11. A device comprising:

an elongated member extendable horizontally and having a first end and a second opposite end;

a first main body having a unitary one piece construction produced from plastic material located symmetrically about a vertical plane, said main body including a pair of downwardly extending legs having first top end portions integrally joined together and further having first bottom end portions spaced apart to rest atop a supporting surface, said legs converge from said bottom end portions to said top end portions, said main body further includes a first mount located atop said top end portions of said legs to mountingly receive said first end of said member;

first fastening means provided at said mount to releasably hold said first end of said member to said first main body;

a second main body having a unitary one piece construction produced from plastic material locted symmetrically about a vertical plane, said second main body including a pair of downwardly extending second legs having second top end portions integrally joined together and further having second bottom end portions spaced apart to rest atop a supporting surface, said second legs converge from said second bottom end portions to said second top end portions, said second main body further includes a second mount located atop said second top end portions of said second legs to mountingly receive said second opposite end of said member; and fastening means provided at said second mount to releasably hold said second opposite end of said member to said second main body; and wherein:

said first bottom end portions and said second bottom end portions include indicating means located on each leg with said indicating means on each leg horizontally aligned together, said indicating means marking alternative locations of each leg for severing and removing part of each leg to adjust the height of said member relative to said supporting surface.

12. The support of claim 11 wherein:

each of said legs include inwardly opening c-shaped cross sections, said c-shaped cross section of each leg has a first leg wall and a second leg wall in parallel arrangement joined together by a third leg wall extending perpendicularly therebetween, each leg includes a plurality of horizontally extending and parallel inner walls integrally joined to and extending between said first leg wall, said second leg wall and said third leg wall, said inner walls of each leg vertically aligned with inner walls of the other legs; and said indicating means includes marks on each leg at each inner wall allowing said first leg wall, said second leg wall, and said third leg wall to be severed thereat providing the lowermost of said inner walls to support said legs upon said supporting surface.

* * * * *